United States Patent [19]

Krautkremer et al.

[11] 4,278,431

[45] Jul. 14, 1981

[54] HYDRO-JET PROPULSION DEVICE FOR DRIVING AND CONTROLLING OF PARTICULARLY FLAT-BOTTOMED WATERCRAFTS

[75] Inventors: Franz Krautkremer, Spay; Gerd Krautkraemer, Boppard-Buchenau, both of Fed. Rep. of Germany

[73] Assignee: Schottel-Werft. Josef Becker GmbH & Co. KG, Spay, Fed. Rep. of Germany

[21] Appl. No.: 968,430

[22] Filed: Dec. 11, 1978

[30] Foreign Application Priority Data

Dec. 22, 1977 [DE] Fed. Rep. of Germany ..... 2757454

[51] Int. Cl.[3] ..... B63H 11/02

[52] U.S. Cl. ..... 440/42; 440/47; 440/53; 114/151; 60/221

[58] Field of Search ..... 114/151; 60/221, 222; 115/11, 12 R, 12 A, 14, 16, 39, 42, 35; 440/38–47, 53

[56] References Cited

U.S. PATENT DOCUMENTS

| | | | |
|---|---|---|---|
| 3,098,464 | 7/1963 | Holland | 115/12 R |
| 3,494,320 | 2/1970 | Stubblefield | 115/12 A |
| 3,807,344 | 4/1974 | Giacosa | 115/12 A |
| 3,893,405 | 7/1975 | Lais | 115/12 R |
| 3,903,833 | 9/1975 | Lais | 114/151 |

FOREIGN PATENT DOCUMENTS

| | | | |
|---|---|---|---|
| 2004045 | 11/1969 | France | 115/12 R |

*Primary Examiner*—Trygve M. Blix
*Assistant Examiner*—D. W. Keen
*Attorney, Agent, or Firm*—Blanchard, Flynn, Thiel, Boutell & Tanis

[57] ABSTRACT

A hydro-jet drive for watercraft. A device is provided applicable for mounting in the hull of a boat by which a jet stream can be created and directed in any desired direction for movement of the boat accordingly. There is provided an elbow having an intake portion and a substantially horizontal discharge opening. The elbow is rotatable on an axis of rotation and contains a suitable motor driven impeller. A motor driven device is provided for rotating the elbow about the axis of rotation thereof for effecting discharge in an operator determined direction. The axis of rotation of the impeller is arranged eccentrically with respect to the axis of rotation of the elbow. The device is particularly adaptable for shallow draft vessels.

7 Claims, 4 Drawing Figures

HYDRO-JET PROPULSION DEVICE FOR DRIVING AND CONTROLLING OF PARTICULARLY FLAT-BOTTOMED WATERCRAFTS

FIELD OF THE INVENTION

The invention relates to a hydro-jet propulsion device and, more particularly, to a device having a thrust producing element, such as a drivable propeller pump arranged within the body of a ship eccentrically with respect to the axis of rotation of a housing enclosing same.

BACKGROUND OF THE INVENTION

Ships for shallow waters have little draught and, therefore, react sensitively to weight and displacement changes, in particular for the passage of water through the propulsion device, channels or tunnels are provided in the ship's hull. Moreover, such ships are much endangered due to striking underwater objects and should moreover be very maneuverable.

A propulsion device for such watercrafts should, therefore, at the same time meet the following tasks. The propulsion device must be recessed in a protected manner, in particular protecting same against engagement with underwater objects and it must be suited for small maneuverable vehicles because of the narrow waterways through which it often must move. Thus the propulsion device must require a small amount of space and be of a light weight. Because of the shallow waters which must be travelled, the propulsion device must function self-drawingly at a very small draught and must be insensitive to small water depths and bottom clearances of the ship, in particular insensitive against the flowing through of sand, stones, ice and other contaminants. The requested good maneuverability is best solved with a smooth round controllable thrust jet.

Hydro-jet propulsion devices are already known, which, however, do not meet in combination the above-listed conditions. In particular they do not meet the requirement for a small enclosed area, small weight and good efficiency in an optimum manner.

Therefore, an object of the invention is to provide a hydro-jet propulsion device of the above-described type having a light weight, small space requirement and good efficiency.

The basic object of the invention is met with a hydro-jet propulsion device wherein the axis of rotation of the impeller of the pump is oriented eccentrically with respect to the axis of rotation of the elbow.

The pump is thereby a propeller or radial pump of an axial, semi-axial or radial construction.

An elbow is a device which diverts a jet of water from one direction into another direction, thus for example includes also a spiral housing which diverts a jet of water which is axial with respect to the pump into a radial jet.

The efficiency of the jet propulsion is increased by a development of the invention wherein the axis of rotation of the impeller is inclined to the vertical. This embodiment has also the advantage, that the reaction moment of the pump acts less on the control drive.

Further advantages and characteristics of the invention can be taken from the following description.

BRIEF DESCRIPTION OF THE DRAWINGS

The invention is discussed with reference to the exemplary embodiments which are shown in FIGS. 1 to 3.

DETAILED DESCRIPTION

Figure 1:
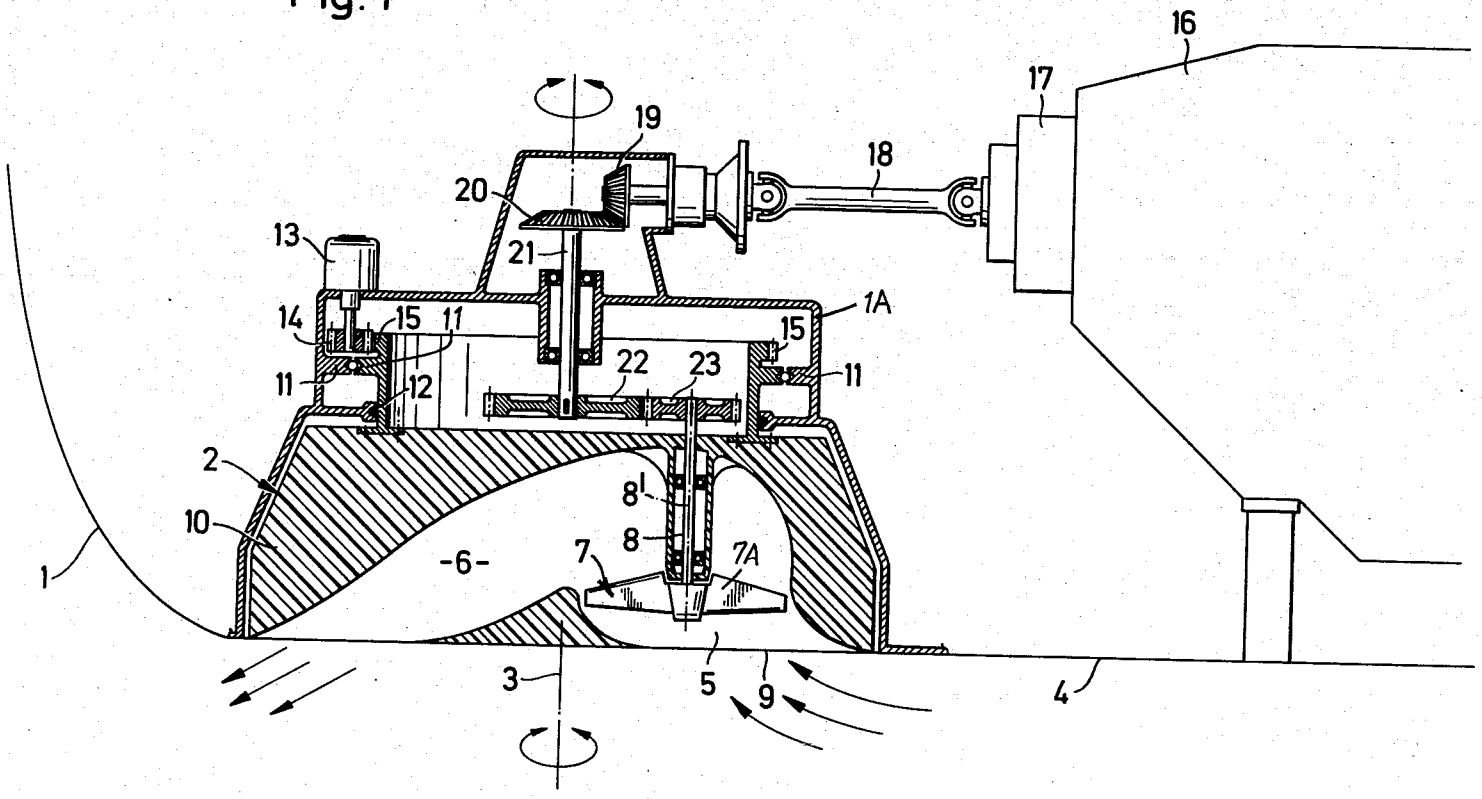
FIG. 1 is a schematic cross-sectional view of a jet propulsion device according to the invention, in which the axis of rotation of the pump and swivel axis of the elbow are arranged parallel to one another.

An elbow 2 is pivotally supported about a vertical axis of rotation 3 in the ship's hull 1 (FIG. 1). The elbow consists of an inlet port 5, which transfers into a discharge outlet port 6. The discharge outlet port can be constructed in the form of a nozzle. A thrust producing device, such as a propeller pump 7 having a propeller 7A, is arranged between the inlet port and the discharge outlet port, which propeller 7A is secured to the lower end of a vertically extending propeller shaft 8 defining an axis of rotation 8' for the propeller 7A. The propeller shaft 8 is rotatably supported in the elbow 2, so that the axis of rotation 8' of the propeller pump is arranged eccentrically and parallel to the axis of rotation 3. The opening 9 to the inlet port 5 can be shaped to conform to the flow direction of the water. The discharge outlet port is directed downwardly inclined to the horizontal which creates, when water is pumped therefrom, a drive component for the ship. It is important that the axis of rotation 8' is arranged eccentrically with respect to the axis of rotation 3, from which results a very small and compact housing 10 of the elbow 2. The housing 10 is rotatably supported snugly in the ship's hull and does not project below the bottom surface of the ship 4 or the keel thereof. The propeller 7A of the propeller pump 7 is arranged closely above the suction opening. The opening 9 to the inlet port 5 can be covered by a not shown grid, to prevent the entrance of foreign objects. The housing 10 of the elbow 2 may consist totally or partially of a foamable plastic (moldable synthetic resin material), through which a watertight and very light-weight housing is made possible. The support of the housing is indicated schematically by a bearing 11 between a flange on an annular upstanding shell 11A connected to the upper wall of the housing 10. The invention is not to be limited to the illustrated support and all conventional viewpoints for a suitable support are to be considered. Reference numeral 12 schematically indicates a seal which can be combined with a second bearing support.

The swivel or rotatable movement of the elbow 2 or its housing 10 is driven by a control motor 13, which acts onto the elbow through a pinion 14 secured to the output shaft of the control motor and a gear 15 which, in this embodiment, is integral with the shell 11A. A worm gearing or a different suitable gearing can be provided in place of the above.

The propeller pump 7 is drivingly rotated from a drive motor 16 mounted in the hull of the ship. In the embodiment of FIG. 1, the drive acts from the drive motor 16 if desired through a coupling 17, a drive shaft 18, a bevel pinion 19 onto a bevel gear 20, which is positioned on the upper end of a vertically extending transmission shaft 21 which is rotatably supported in a wall 1A of the ship coaxial with the axis of rotation 3 of the elbow 2 in the ship's hull. A gear 22 is arranged at the lower free end of the transmission shaft, which gear 22 mates with a second gear 23, which is secured to the upper end of the propeller shaft 8. The very small diameter of the elbow housing 10 is made possible, as stated above, by the eccentric location of the propeller shaft 8 relative to the axis of rotation. The elbow can furthermore be made lighter by manufacturing the housing 10 entirely or partially of a foamable plastic, namely, for example by filling with foamed plastic the corresponding space in the ship's hull.

Figure 2:
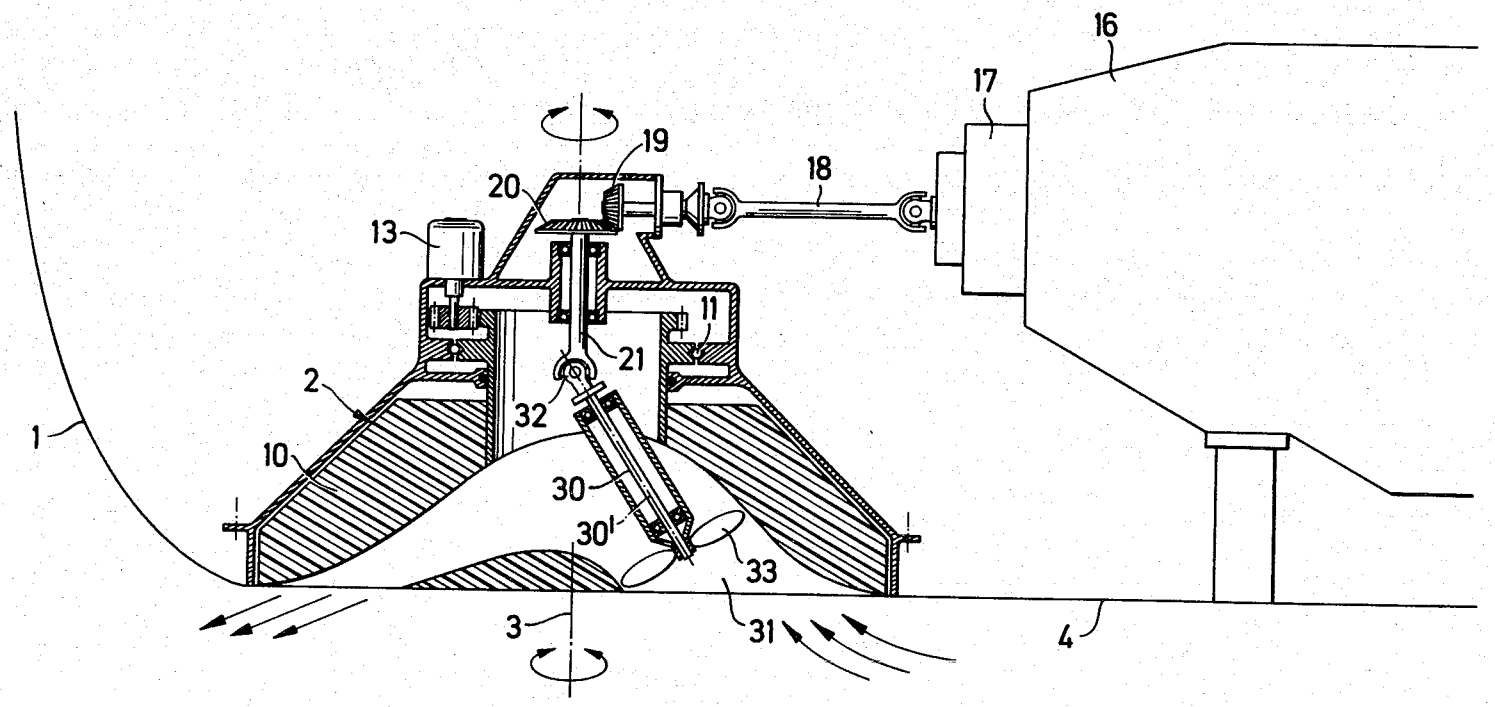
FIG. 2 illustrates an exemplary embodiment having a propeller pump and an inclined axis of rotation.

FIG. 2 illustrates an exemplary embodiment of the invention, in which the propeller shaft 30 of the propeller pump and the inlet port 31 are inclined to the horizontal toward the discharge outlet port. From this results a smaller suction resistance, especially since the suction opening can be designed with hydrodynamically favorable characteristics. Furthermore, the suction of the propeller results in a force component in the drive direction. The propeller shaft 30 can be coupled to the transmission shaft 21 by means of a universal joint 32 or a bevel gear or a drive shaft (corresponding with FIG. 3) or a different suitable element. The torque can also be transmitted by the drive motor 16 driving a pump or electric current generator and by arranging an associated hydraulic or electric motor on the propeller shaft 30. As a result, a very advantageous possibility for the distribution of a motor and one or several jet propeller devices in the ship can be obtained.

The reaction of the propeller torque onto the control drive is alleviated by the sloped position of the propeller shaft 30.

Figure 3:
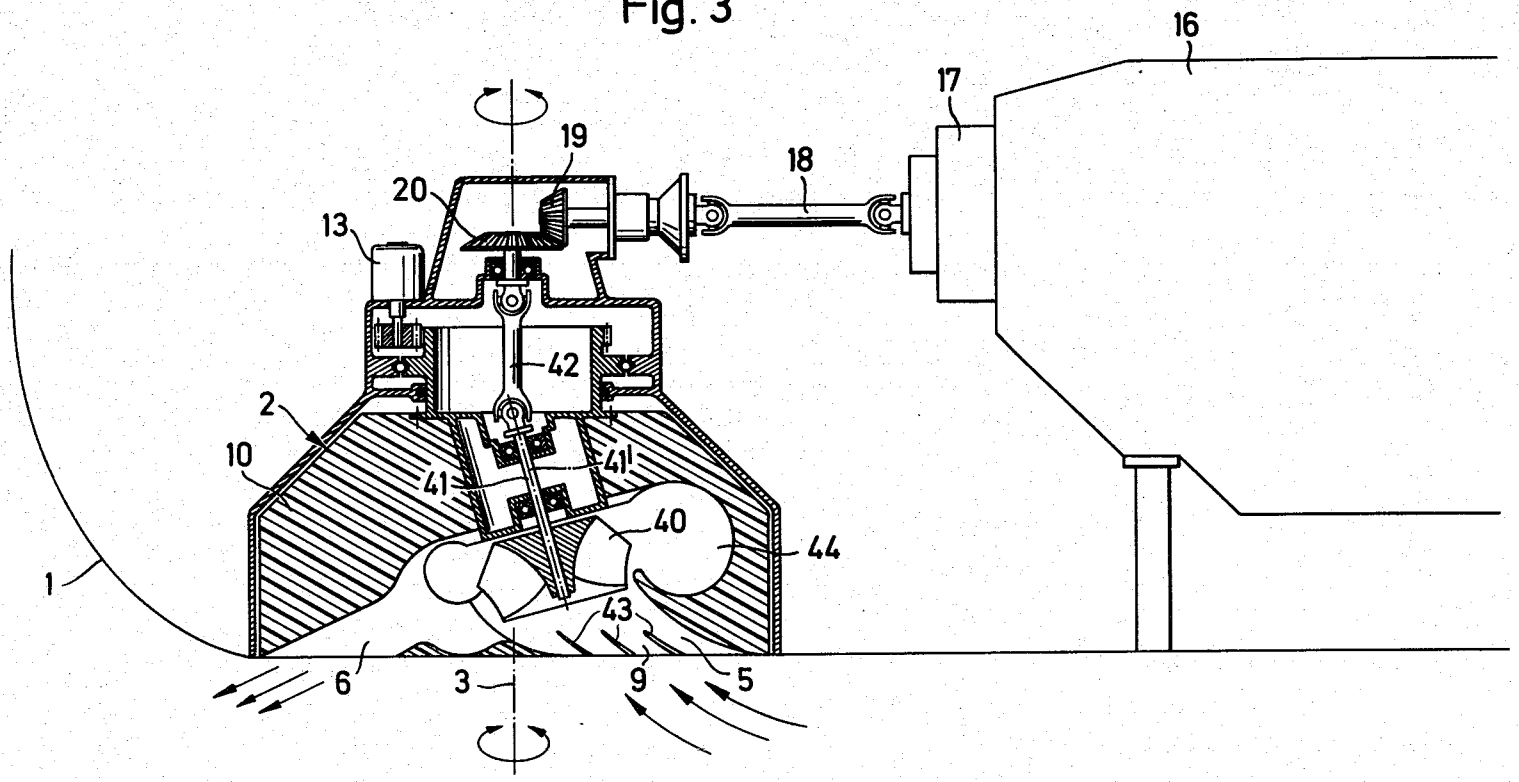
FIG. 3 illustrates an exemplary embodiment of the invention having a centrifugal pump (radial pump) and an inclined axis of rotation.

FIG. 3 illustrates an embodiment, in which the propeller pump is replaced with a centrifugal pump 40, which is installed with an inclined pump shaft 41 into the elbow 2, so that the centrifugal pump lies eccentrically to the axis of rotation 3. The centrifugal pump is driven by the drive motor 16 through the above-mentioned gear elements and through a second drive shaft 42, which, differing from FIG. 3, can be inclined slightly like the propeller shaft 41, in order to evenly distribute the angles of bend of the cardan joints or universal joints. The opening 9 to the inlet port can have guide blades or vanes 43 or the like, in order to make the passage of water into the inlet easier. The water is drawn in axially by the centrifugal pump and is moved into a spiral-shaped housing 44, which terminates in the discharge outlet 6. The discharge outlet is arranged just like in the preceding examples inclined so that a propulsive drive component is generated for the ship. Also the inlet port 5 is inclined and possibly angled such that the suction force results in a propulsive component for the ship. In all described embodiments, the housing 10 of the elbow is designed and installed in the ship such that it adapts exactly to the opening of the ship and is flush with the bottom of the ship. As a result, the resistance to movement and the lifting losses of the watercraft are reduced to a minimum.

Figure 4:
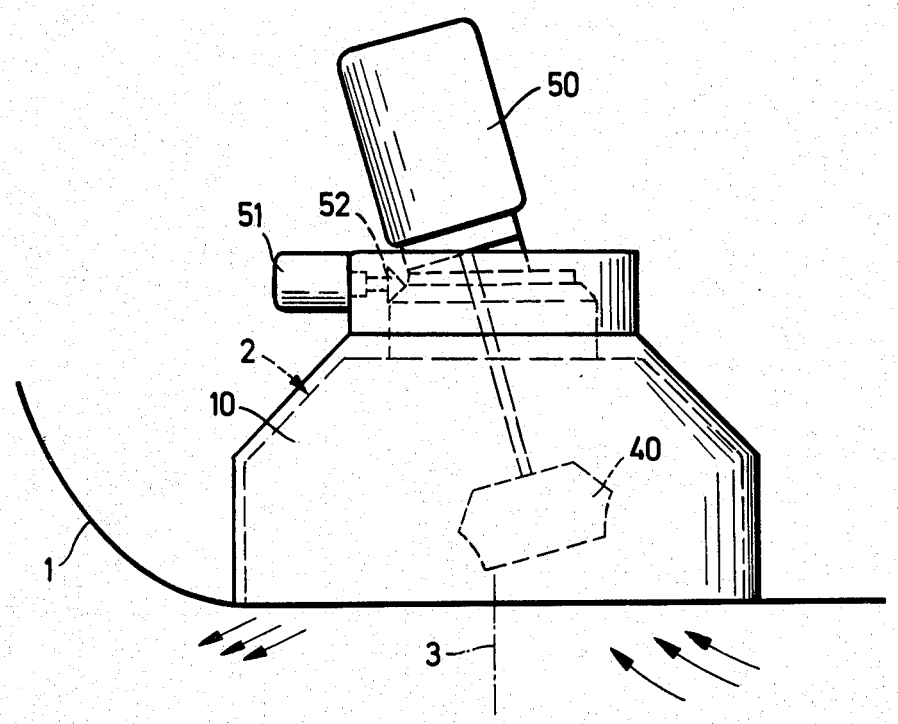
FIG. 4 illustrates another exemplary embodiment wherein the propeller drive motor is mounted on the elbow for movement therewith.

In another embodiment (FIG. 4), the propeller drive motor 50 for the propeller 40 is mounted on the elbow 2 and is movable therewith. The elbow 2 is driven relative to the hull by the motor 51 and gearing 52 similar to the motor 13 and gearing described above.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A hydro-jet propulsion device for driving and controlling shallow draught watercraft, comprising:
   hull means;
   means defining a downwardly opening recess in a bottom surface of said hull means, said opening having a central vertical axis and an inner surface contour over the entire axial extent thereof which is concentric with said central vertical axis;
   elbow means and support means for rotatably supporting said elbow means in said downwardly opening recess and for movement about an axis of rotation which is coaxial with said central vertical axis, said elbow means having a bottom surface which is generally flush with the outer surface of said hull means, said elbow means additionally having a radially outer surface contour conforming to the contour of said inner surface of said downwardly opening recess and being spaced slightly radially inwardly therefrom, said elbow means having means defining a passageway therethrough, said passageway having first and second segments, each of said segments having a longitudinal axis inclined to said axis of rotation of said elbow means, each of said first and second segments opening outwardly of said bottom surface of said elbow means and at locations whereat the central axes of the two openings in said bottom surface of said elbow means are spaced radially outwardly from said axis of rotation of said elbow means; and
   propeller pump means and drive means therefor, said propeller pump means being mounted in said first segment of said passageway for drawing in water through one of said two openings in said bottom surface and ejecting water from the other of said two openings in said bottom surface, the axis of rotation of said propeller pump means being inclined to said axis of rotation of said elbow means, said drive means including means facilitating a drive of said propeller pump means about said inclined axis of rotation thereof.

2. The hydro-jet propulsion device according to claim 1, wherein said propeller pump means includes a propeller rotatably supported in said first segment of said passageway.

3. The hydro-jet propulsion device according to claim 1, wherein the pump is a centrifugal pump.

4. The hydro-jet propulsion device according to claim 1, wherein said drive means for said propeller pump means is supported on said hull means.

5. The hydro-jet propulsion device according to claim 1, wherein said drive means for said propeller pump means is supported on said elbow means.

6. The hydro-jet propulsion device according to claim 1, wherein said elbow means is made of a foamed plastic material.

7. The hydro-jet propulsion device according to claim 1, wherein the geometric center of said propeller pump means is radially offset from said axis of rotation of said elbow means.

* * * * *

UNITED STATES PATENT AND TRADEMARK OFFICE

CERTIFICATE OF CORRECTION

PATENT NO. : 4 278 431

DATED : July 14, 1981

INVENTOR(S) : Franz Krautkremer, Gerd Krautkraemer and Siegfried Lais

It is certified that error appears in the above—identified patent and that said Letters Patent is hereby corrected as shown below:

In the heading information, change "[75] Inventors: Franz Krautkremer, Spay; Gerd Krautkraemer, Boppard-Buchenau, both of Fed. Rep. of Germany" to ---[75] Inventors: Franz Krautkremer, Spay; Gerd Krautkraemer, Boppard-Buchenau; Siegfried Lais, Spay, all of Fed. Rep. of Germany---.

Signed and Sealed this

*Third* Day of *November 1981*

[SEAL]

*Attest:*

GERALD J. MOSSINGHOFF

*Attesting Officer*

*Commissioner of Patents and Trademarks*